US010272300B1

(12) United States Patent
Shannon

(10) Patent No.: US 10,272,300 B1
(45) Date of Patent: Apr. 30, 2019

(54) PUTTER

(71) Applicant: Michael Shannon, Carlsbad, CA (US)

(72) Inventor: Michael Shannon, Carlsbad, CA (US)

( * ) Notice: Subject to any disclaimer, the term of this patent is extended or adjusted under 35 U.S.C. 154(b) by 0 days.

(21) Appl. No.: 15/843,851

(22) Filed: Dec. 15, 2017

(51) Int. Cl.
*A63B 53/06* (2015.01)
*A63B 53/04* (2015.01)
*A63B 53/00* (2015.01)

(52) U.S. Cl.
CPC ..... *A63B 53/0487* (2013.01); *A63B 53/007* (2013.01); *A63B 2053/0441* (2013.01); *A63B 2053/0491* (2013.01)

(58) Field of Classification Search
USPC ..... 473/241–354
See application file for complete search history.

(56) References Cited

U.S. PATENT DOCUMENTS 2,919,922 A * 1/1960 Skelly ..... A63B 69/3685 33/334
2,976,046 A * 3/1961 McCullough, Jr. ..... A63B 69/3685 33/334
3,134,596 A * 5/1964 Boznos ..... A63B 53/0487 273/DIG. 16
3,199,873 A * 8/1965 Surratt ..... A63B 69/3685 446/901
3,240,497 A * 3/1966 Taylor ..... A63B 69/3685 473/241
3,306,618 A * 2/1967 Liljequist ..... A63B 53/0487 33/334
3,753,564 A * 8/1973 Brandell ..... A63B 69/3614 473/220
4,032,156 A * 6/1977 Clarke ..... A63B 69/3685 473/253
D245,437 S * 8/1977 Thiel ..... 473/252
4,222,566 A * 9/1980 Berry ..... A63B 53/0487 473/250
4,324,404 A * 4/1982 Dian ..... A63B 53/007 273/DIG. 14
4,340,229 A * 7/1982 Stuff, Jr. ..... A63B 69/3685 473/240

(Continued)

FOREIGN PATENT DOCUMENTS

GB 2236954 A * 4/1991 ..... A63B 53/0487
JP 51139438 A * 12/1976

(Continued)

*Primary Examiner* — Alvin A Hunter
(74) *Attorney, Agent, or Firm* — John R. Ross, III; John R. Ross

(57) ABSTRACT

A putter having a shaft and a putter head connected to the shaft. The putter head has an upper putter head connected to a lower putter head. The upper putter head has an upper putter head top side and an upper putter head bottom side. The lower putter head has a lower putter head top side and a lower putter head bottom side. The putter has striking face formed into the putter head. A transparent object display chamber is sandwiched between the upper putter head and the lower putter head. The transparent object display chamber is enclosed by the upper putter head and the lower putter head. A display object is removably positioned within the display chamber. A transparent positioning window extends through the putter head and includes markings which allow for proper positioning of the golfer and proper positioning of the striking face.

11 Claims, 8 Drawing Sheets

(56) References Cited

U.S. PATENT DOCUMENTS 4,369,974 A * 1/1983 Komperda ..... A63B 53/007 273/DIG. 14
4,423,874 A * 1/1984 Stuff, Jr. ..... A63B 69/3685 473/338
4,530,505 A * 7/1985 Stuff ..... A63B 69/3685 473/250
4,722,528 A * 2/1988 Tsao ..... A63B 53/0487 473/254
4,824,114 A * 4/1989 Catalano ..... A63B 69/3685 33/334
4,902,014 A * 2/1990 Bontomase ..... A63B 69/3685 473/241
5,209,470 A * 5/1993 Cimaroli ..... A63B 69/3685 473/241
5,219,169 A * 6/1993 Martini ..... A63B 53/04 473/241
5,244,210 A * 9/1993 Au ..... A63B 53/0487 473/252
5,324,031 A * 6/1994 Green ..... A63B 53/0487 273/DIG. 16
5,429,366 A * 7/1995 McCabe ..... A63B 69/3685 473/242
5,477,291 A * 12/1995 Mikami ..... G03B 19/026 396/335
5,643,100 A * 7/1997 Zabytko ..... A63B 53/0487 273/DIG. 16
5,707,299 A * 1/1998 McKenna ..... A63B 69/3685 473/241
5,788,587 A * 8/1998 Tseng ..... A63B 53/04 473/326
5,800,279 A * 9/1998 Densberger ..... A63B 53/0487 473/220
5,818,036 A * 10/1998 Daly ..... A63B 69/3614 250/216
5,842,935 A * 12/1998 Nelson ..... A63B 53/0487 473/342
5,857,920 A * 1/1999 Hong ..... A63B 69/3685 473/240
5,921,868 A * 7/1999 DiMartino ..... A63B 69/3685 473/252
5,935,015 A * 8/1999 Spiegel ..... A63B 69/3685 33/508
5,964,668 A * 10/1999 Tai ..... A63B 69/3614 362/259
6,062,986 A * 5/2000 Kaise ..... A63B 53/0487 473/242
6,080,215 A * 6/2000 Stubbs ..... B24D 3/28 51/293
6,241,624 B1 * 6/2001 Zabytko ..... A63B 53/04 473/340
6,277,160 B1 * 8/2001 Stubbs ..... B24D 11/04 51/293
6,302,804 B1 * 10/2001 Budde ..... A63B 53/0487 273/DIG. 8
6,443,855 B1 * 9/2002 Tseng ..... A63B 53/0466 473/326
6,729,972 B2 * 5/2004 Boord ..... G09F 23/00 473/340
7,025,692 B2 * 4/2006 Erickson ..... A63B 53/0466 473/335
7,052,409 B2 * 5/2006 Goldsmith ..... A63B 53/0487 473/242
7,186,185 B2 * 3/2007 Nagy ..... A63B 53/04 473/238
7,226,362 B1 * 6/2007 Schell ..... A63B 53/0487 473/238
7,226,366 B2 * 6/2007 Galloway ..... A63B 53/0466 473/332
7,485,047 B2 * 2/2009 Evans ..... A63B 53/0487 473/249
7,611,419 B2 * 11/2009 O'Neill ..... A63B 53/04 473/242
7,625,298 B2 * 12/2009 Bennett ..... A63B 53/02 473/334
7,766,762 B2 * 8/2010 Stellander ..... A63B 53/0487 473/251
7,789,764 B2 * 9/2010 Wilson ..... A63B 53/0487 473/220
7,922,607 B2 * 4/2011 Morgan ..... A63B 37/0003 473/409
7,959,519 B2 * 6/2011 Zielke ..... A63B 53/04 473/249
7,993,216 B2 * 8/2011 Lee ..... A63B 53/0466 473/334
8,128,505 B2 * 3/2012 Tryner ..... A63B 53/0487 473/242
8,337,321 B2 * 12/2012 Bittner ..... A63B 53/0487 473/265
8,388,461 B1 * 3/2013 Martinez, Jr. ..... A63B 69/3608 473/210
8,616,992 B2 * 12/2013 Kim ..... A63B 53/0487 473/252
8,721,472 B2 * 5/2014 Kuan ..... A63B 53/0487 473/341
8,932,144 B2 * 1/2015 Simizu ..... A63B 53/0487 473/238
9,717,961 B2 * 8/2017 Cameron ..... A63B 53/0487
2002/0187853 A1 * 12/2002 Beach ..... A63B 53/0466 473/345
2003/0017885 A1 * 1/2003 Heene ..... A63B 53/04 473/324
2003/0054899 A1 * 3/2003 Dupille ..... A63B 53/0487 473/324
2005/0043111 A1 * 2/2005 Albert ..... A63B 53/04 473/324
2006/0154744 A1 * 7/2006 Song ..... A63B 53/0466 473/345
2007/0111816 A1 * 5/2007 Zielke ..... A63B 53/04 473/324

FOREIGN PATENT DOCUMENTS

JP 08196669 A * 8/1996
JP 2004016776 A * 1/2004
JP 2006020817 A * 1/2006
JP 2006334343 A * 12/2006
JP 2013094431 A * 5/2013
WO WO 8902769 A1 * 4/1989 ..... A63B 69/3685

* cited by examiner

PUTTER

The present invention relates to golf equipment, and in particular, to golf putters.

BACKGROUND OF THE INVENTION

The origins of the game of golf can be traced back to over 500 years ago when the Scottish Parliament in 1457 recorded a ban on the game because it was seriously interfering with archery practice. However, the appeal of the game of golf could not be held back and over the years it spread to England, Ireland, the United States and is now virtually played all over the world.

As the sport has evolved, so has the equipment with which it is played. Specialized equipment and accessories are available that may give the golfer an edge or an advantage in perfecting his game.

Putting is a very important part of the game of golf. For a typical par-72 course, putting accounts for about 40 percent of total strokes taken in an average round. That means that a golfer who shoots 90 uses his putter 36 times—nearly three times as often as the driver. Therefore, a golfer who can improve his putting will likely see tremendous results in lowering his handicap.

A putting fundament is that it is important to position your eyes over the ball as you set up for the putt. Also, many golfers now press forward as they putt. By slightly nudging his hands toward the hole before starting the takeaway, the golfer will find it easier to return at impact with his hands ahead of the ball. This will assist in maintaining the ideal amount of clubface loft and making the ball roll smoothly. The forward press also helps the golfer keep his hands moving toward the target during the forward stroke, instead of stopping and allowing the clubhead to pass his hands, which adds loft and often changes the face angle. Finally, the forward press can help the golfer start to establish good tempo and rhythm.

Also, because putters are such an important club, it is desirable for the putter to look attractive. Putters may include decorative features to improve their appearance.

What is needed is an improved putter that looks attractive and also includes features that assist the golfer in making a better putt.

SUMMARY OF THE INVENTION

The present invention provides a putter having a shaft and a putter head connected to the shaft. The putter head has an upper putter head connected to a lower putter head. The upper putter head has an upper putter head top side and an upper putter head bottom side. The lower putter head has a lower putter head top side and a lower putter head bottom side. The putter has striking face formed into the putter head. A transparent object display chamber is sandwiched between the upper putter head and the lower putter head. The transparent object display chamber is enclosed by the upper putter head and the lower putter head. A display object is removably positioned within the display chamber. A transparent positioning window extends through the putter head and includes markings which allow for proper positioning of the golfer and proper positioning of the striking face.

DETAILED DESCRIPTION OF THE PREFERRED EMBODIMENTS

Figure 1:
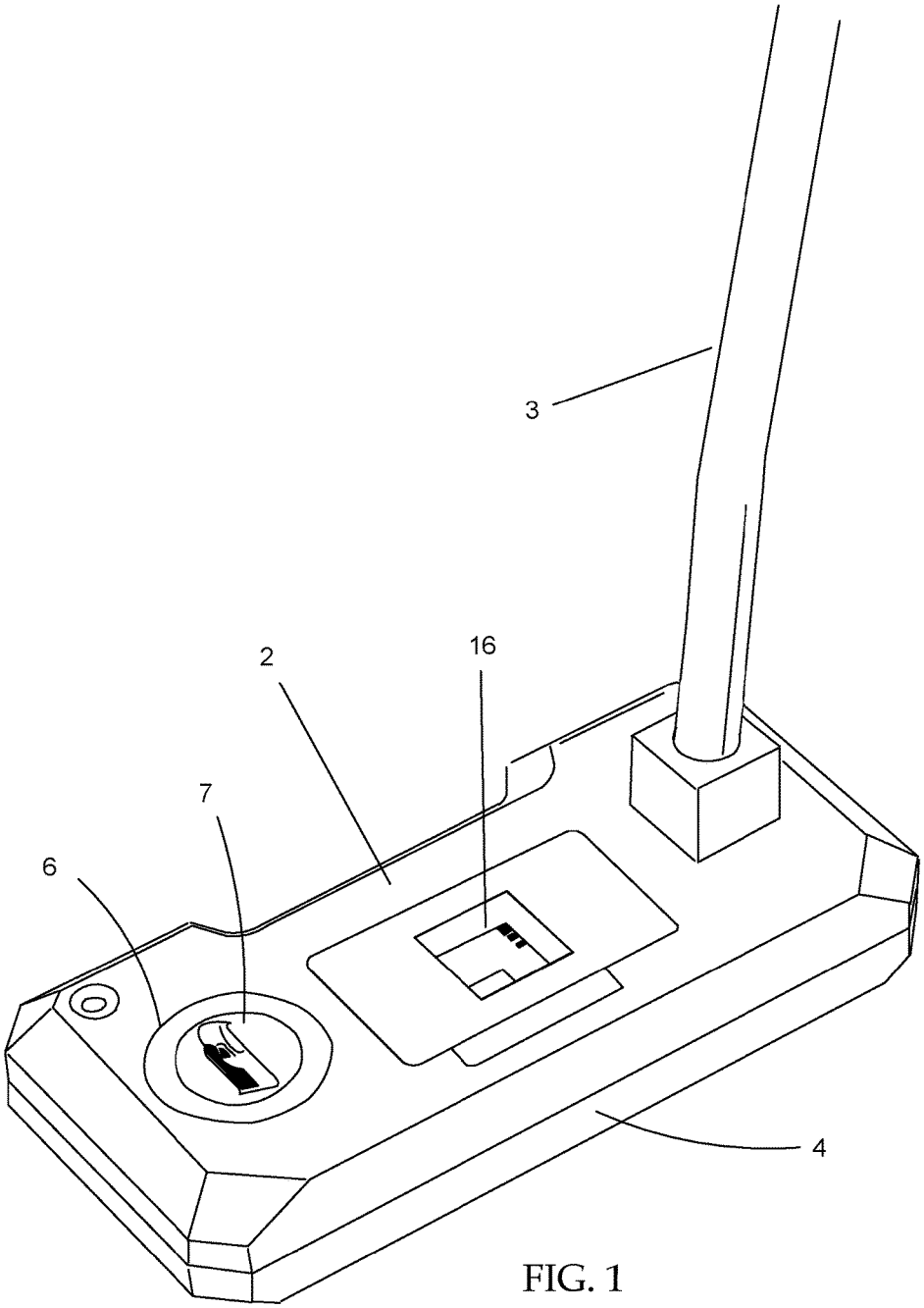
FIG. 1 shows a preferred embodiment of the present invention.
Figure 2:
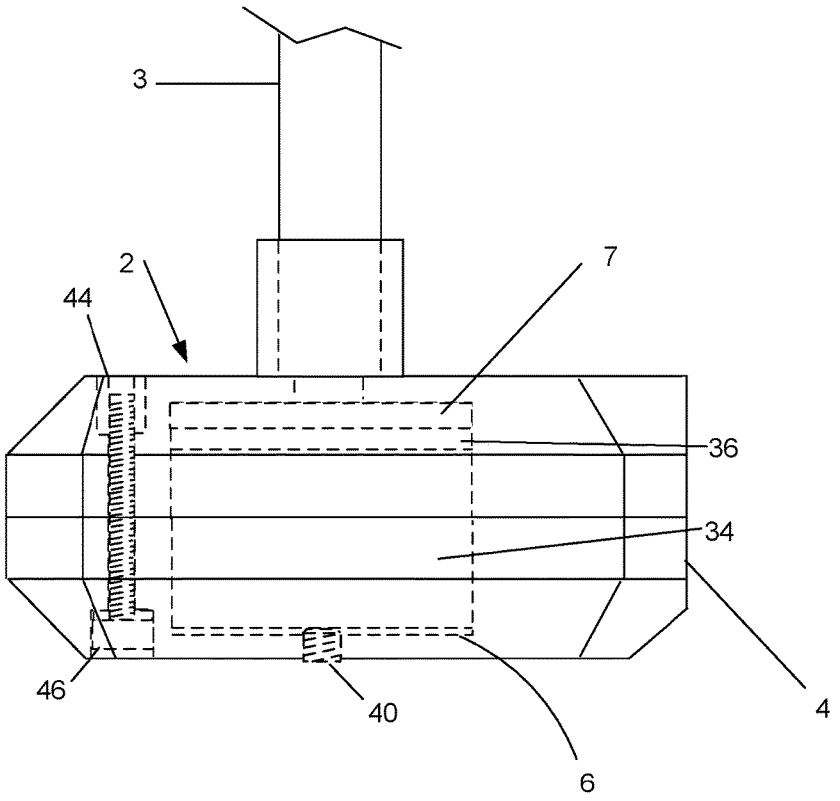
FIG. 2 shows a side view of a preferred putter head.

FIG. 1 shows a preferred embodiment of the present invention. Putter head 2 is rigidly connected to shaft 3. Putter head 2 includes flat striking face 4 (see also FIG. 2). Putter head 2 also includes object display chamber 6. In the embodiment shown in FIG. 1, metallic golf ball marker 7 is being displayed inside display chamber 6. Golf club putter head 2 also includes window 16. By utilizing window 16, the golfer can make sure he has correctly positioned his body and eyes in relation to putter head 2 and the golf ball. For example, by utilizing window 16 a golfer can be sure that his eyes are over the ball prior to putting the golf ball. Also by utilizing window 16 the golfer can press forward so as to adjust the angle of striking face 4 prior to completing the putt.

Components of a Preferred Putting Head

Figure 3:
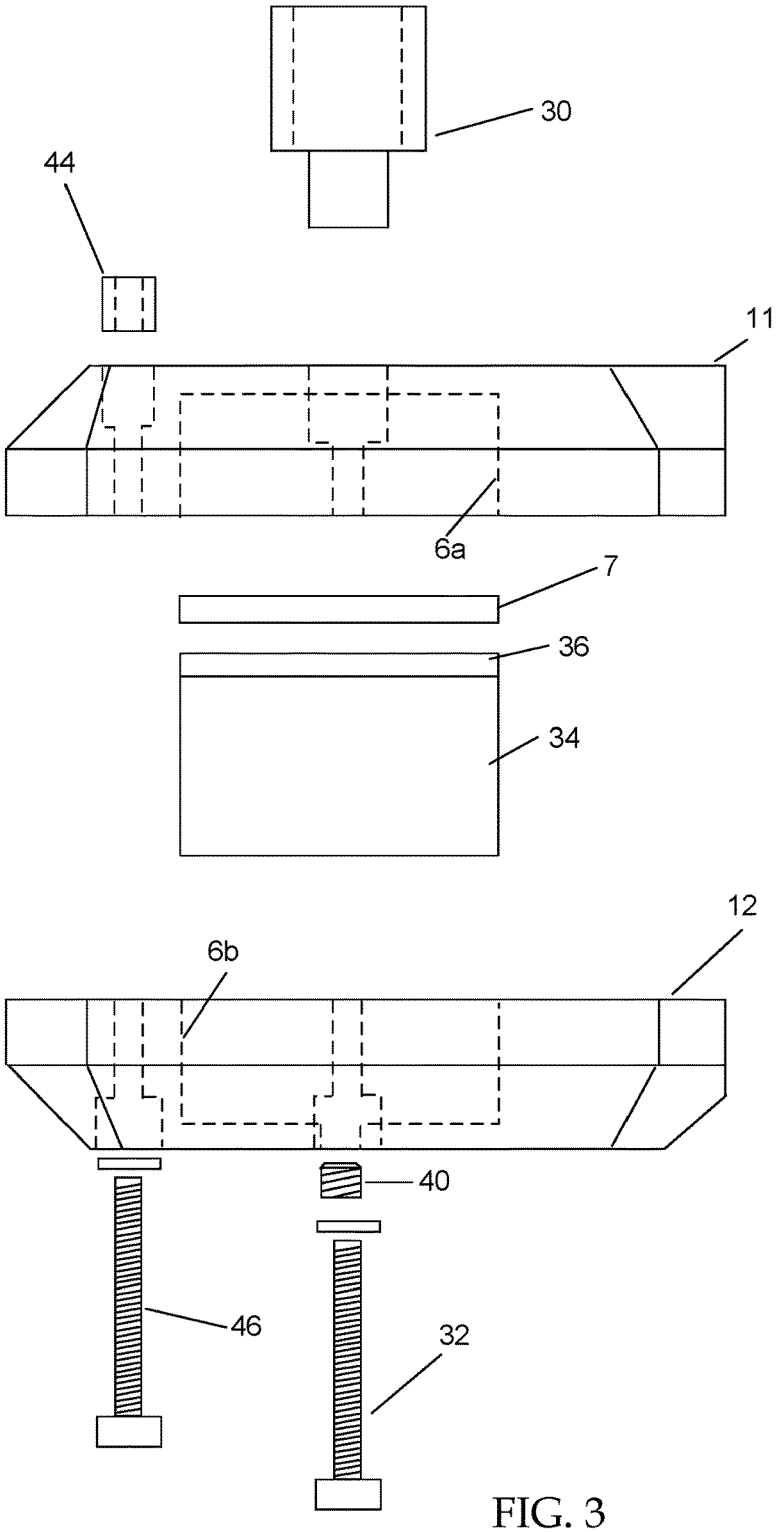
FIG. 3 shows an exploded view of a preferred putter head.
Figure 4:
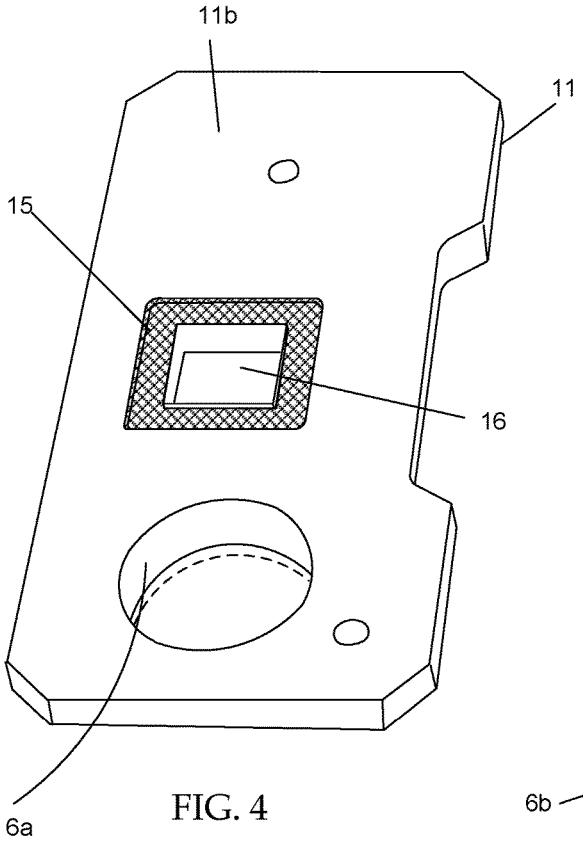
FIG. 4 shows a bottom perspective view of a preferred upper putter head.
Figure 5:
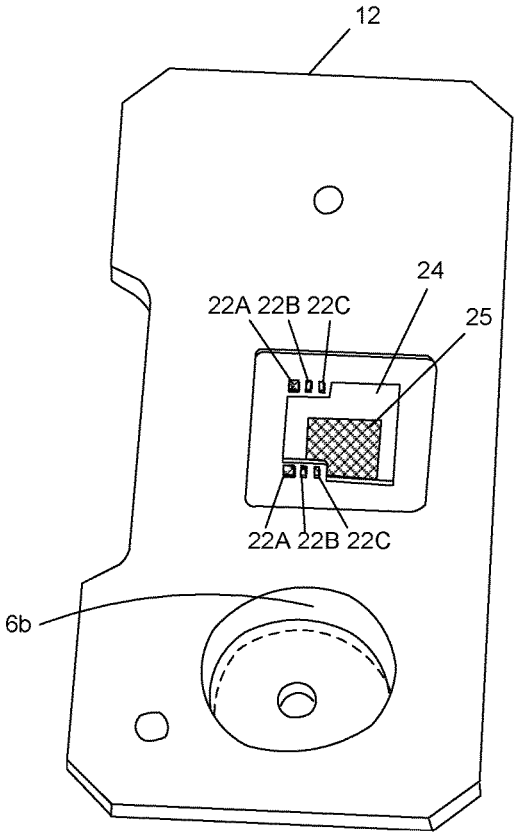
FIG. 5 shows a top perspective view of a preferred lower putter head.
Figure 6:
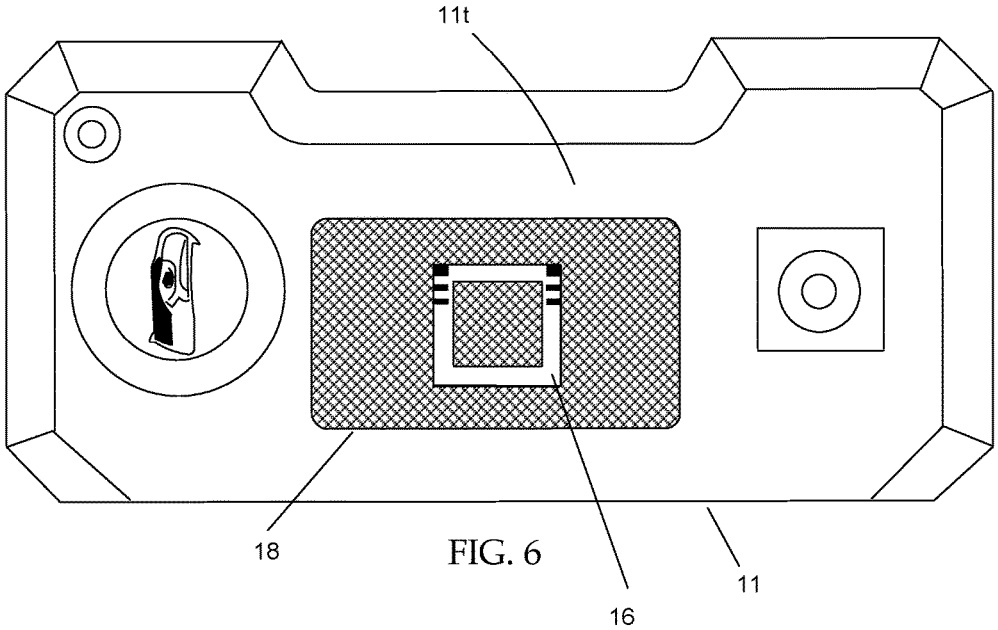
FIG. 6 shows a top view of a preferred putter head.
Figure 7:
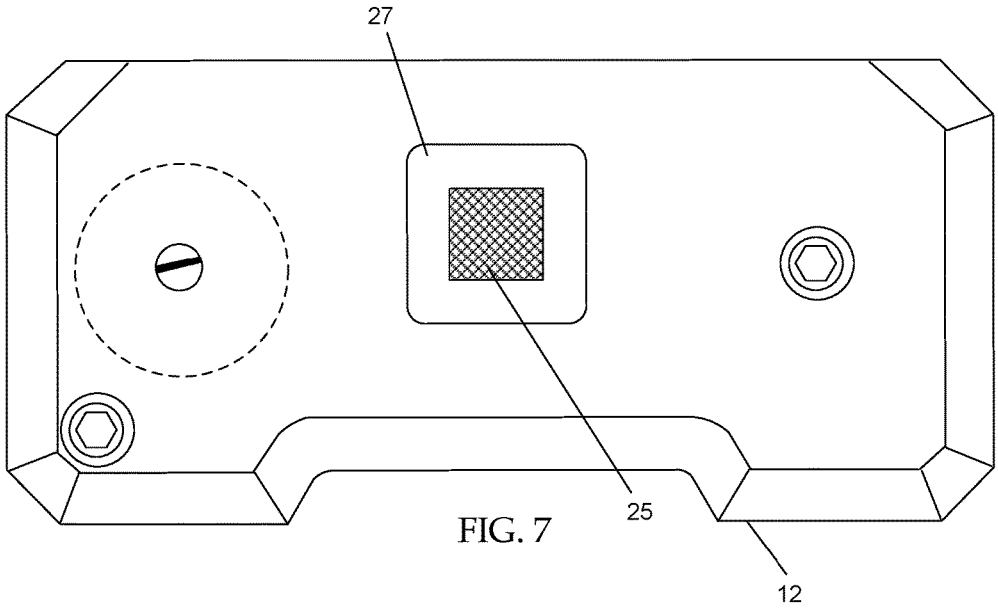
FIG. 7 shows a bottom view of a preferred putter head.

FIG. 3 shows an exploded view of putter head 2. Shaft connecter 30 (FIG. 3) is inserted into the top of upper head 11 and is secured tightly with threaded bolt 32. In a preferred embodiment of the present invention upper head 11 and lower head 12 are both fabricated from transparent acrylic. In a preferred embodiment upper head 11 and lower head 12 are both cut from ½ inch thick acrylic sheets in the shapes shown. FIG. 4 shows a bottom perspective view of upper head 11 and FIG. 5 shows a top perspective view of lower head 12. FIG. 6 shows a top view of putter head 2 fully assembled and FIG. 7 shows a bottom view of putter head 2 fully assembled.

Markings on Putter Head

In a preferred embodiment, putter head 2 includes markings to assist the golfer in proper positioning. In a preferred embodiment the markings are painted onto putter head 2. For example, bottom side 11*b* of upper head 11 includes darkened square section 15 that surrounds clear window 16 (FIG. 4). Top side 11*t* of upper head 11 includes darkened section 18 that surrounds clear window 16 (FIG. 6). Top side 12*t* of lower head 12 includes darkened slashes 22A-22C painted within clear window 24 (FIG. 5). Darkened bottom square 25 is painted on bottom side 12*b* of lower head 12 (FIG. 7) and is visible through window 24. Darkened bottom square 25 is surrounded by white painted section 27, as shown in FIG. 7.

Object Display Chamber

Display chamber 6 allows a golfer to decoratively display objects of his choosing inside the transparent display chamber for viewing. A weight may be added along with the display object to provide optimum weight characteristics for the putter. For example, with the utilization of display chamber 6, the golfer can create a customized decorative toe-weighted putter.

Cylindrical weight 34 fits snuggly into display chamber 6. Display chamber 6 includes lower display chamber 6*b* and upper display chamber 6*a*. In a preferred embodiment flexible magnet 36 is glued to the top of cylindrical weight 34. Cylindrical weight 34 functions to allow the golfer to customize the weight of putter head 2. Cylindrical weight 34 may be fabricated from a variety of materials, including lead, iron or aluminum. Metal golf ball marker 7 is held securely in place by magnet 36. Cylindrical weight 34, magnet 36 and golf ball marker 7 are all sized to fit snuggly within display chamber 6 so that cylindrical weight 34, magnet 36 and golf ball marker 7 remain secure and stationary while putter head 2 is in use. After cylindrical weight 34, magnet 36 and golf ball marker 7 are inserted into display chamber 6, set screw 40 is tightened against the bottom of cylindrical weight 34 to hold cylindrical weight 34 steady in place. Screw insert 44 having internal threads is inserted into upper head 11, as shown. Bolt 46 is bolted through lower head 12 and upper head 11 and is threaded through screw insert 44 to secure putter head 2 tightly together (see also FIGS. 2, 4 and 5).

Utilization of a Preferred Putter Head

As stated above, the markings on putter head 2 allow a golfer to consistently position himself at a desired location so that the golfer is in the best set up position to make the putt. The markings allow the golfer to know if his head is positioned directly over the ball by the viewing the markings through window 16. This also allows relative positions to be obtained by permitting the golfer to move in any direction to achieve optimum set up position. Thus, the golfer may feel confident that a consistent set up position is obtained prior to striking the golf ball.

Figure 8:
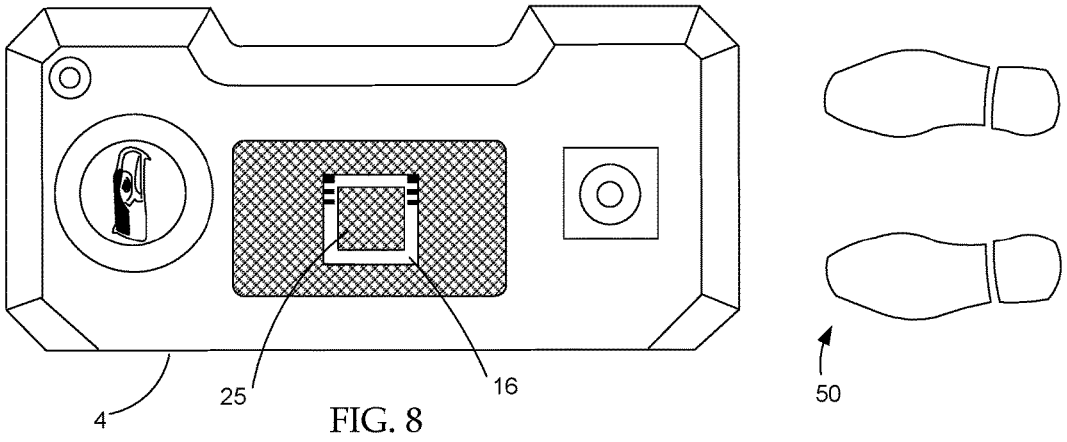
FIGS. 8-10 show a preferred method for using the putter head to set up golfer postion.

For example, in FIG. 8, foot prints 50 show the golfer to be a right-handed golfer. In FIG. 8, the golfer is looking through window 16 and observing darkened bottom square 25. Square 25 is perfectly centered within window 16. Therefore, the golfer knows that his eyes are directly over square 25. Because the golf ball is adjacent striking face 4, the golfer knows that his eyes are over the ball and he is in the desired position to make the putt.

Figure 9:
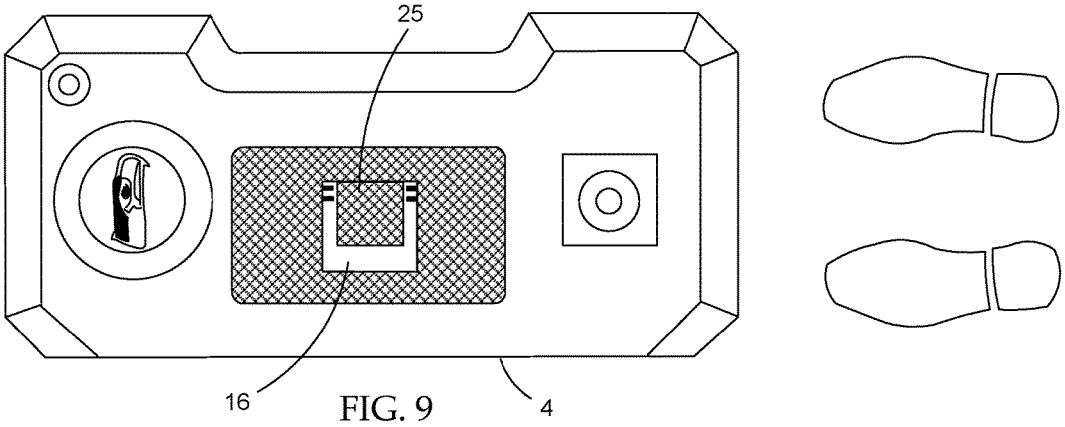

In FIG. 9 the golfer wishes to place his eyes slightly behind the ball to make the putt. The golfer is looking through window 16 and observing darkened bottom square 25. Square 25 is at the rear of window 16. Therefore, the golfer knows that his eyes are behind square 25. Because the golf ball is adjacent striking face 4, the golfer knows that his eyes are behind the ball and he is in the desired position to make the putt.

Figure 10:
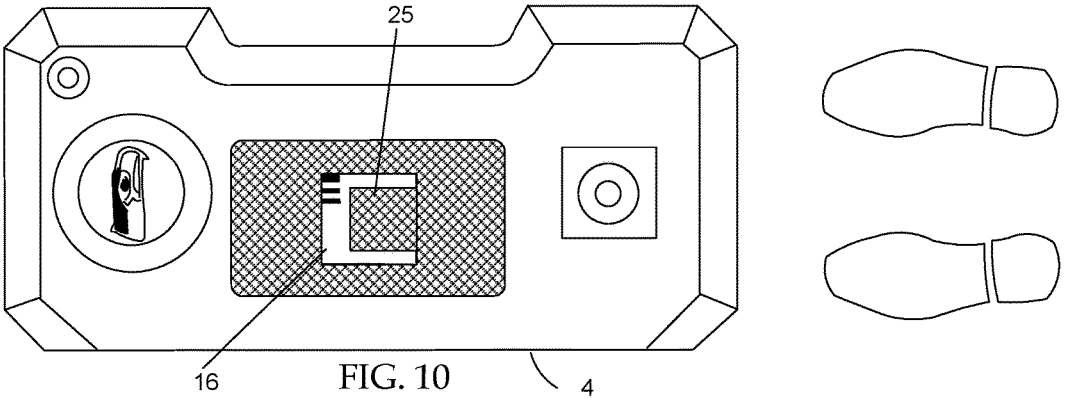

In FIG. 10 the golfer wishes to place his eyes to the right of the ball to make the putt. The golfer is looking through window 16 and observing darkened bottom square 25. Square 25 is to the right side of window 16. Therefore, the golfer knows that his eyes to the right of square 25. Because the golf ball is adjacent striking face 4, the golfer knows that his eyes to the right of the ball and he is in the desired position to make the putt.

Pressing Forward

Slash markings 22A-22C allow the golfer to receive visual feedback with relation to the angle of the striking face. At set up the golfer may press his hands forward to create a forward leaning shaft which will decrease the angle of the striking face. The degree will be able to be recognized by slashes 22A-22C that are either blocked by darkened section 18 or viewable. Slashes 22A—22C are viewable or blocked as the golfer presses forward and adjusts the angle.

Figure 11:
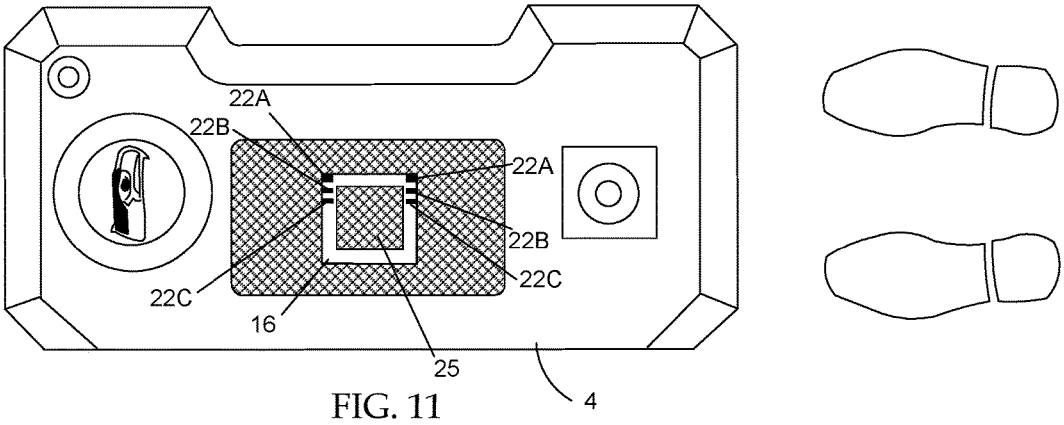
FIGS. 11-16 show a preferred method for pressing forward.
Figure 14:
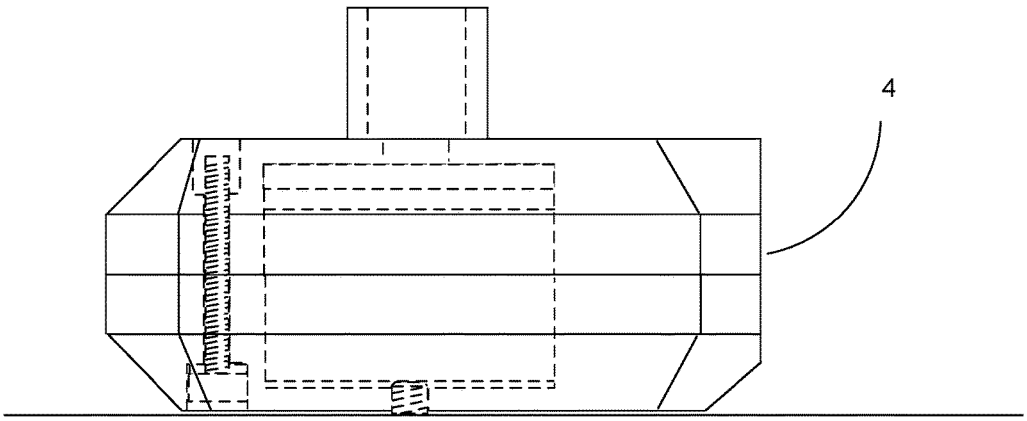

In FIG. 11, the golfer does not wish to press forward. Square 25 is centered within window 16 and slashes 22A-22C are all visible. The golfer is positioned with his eyes over the ball and putter head 2 is level so that striking face 4 will strike the golf ball flush (FIG. 14).

Figure 12:
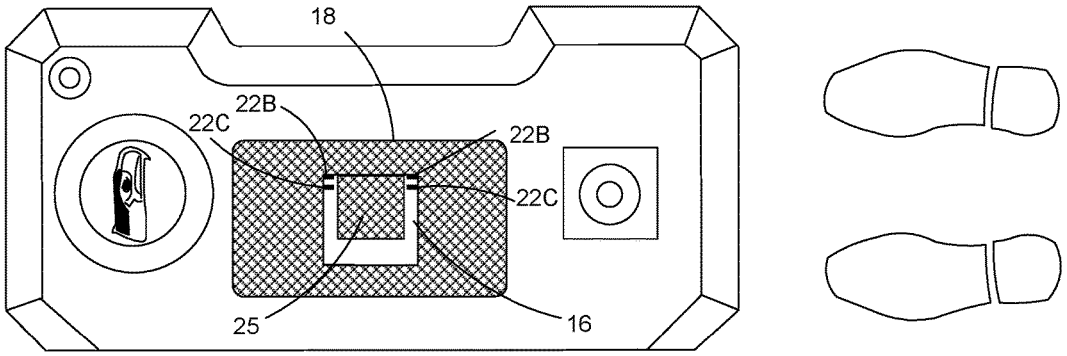
Figure 15:
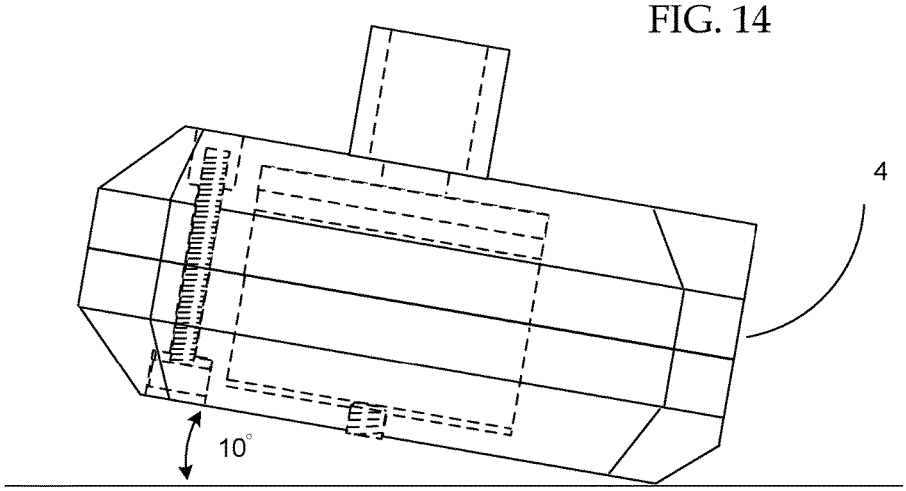

In FIG. 12, the golfer wishes to press forward. Square 25 has moved rearward within window 16 and slashes 22B-22C are still visible. However, slashes 22A are covered by darkened section 18 and are no longer visible. The golfer is positioned with his eyes over the ball and putter head 2 is at an angle so that striking face 4 will strike the golf ball of approximately 10 degrees (FIG. 15).

Figure 13:
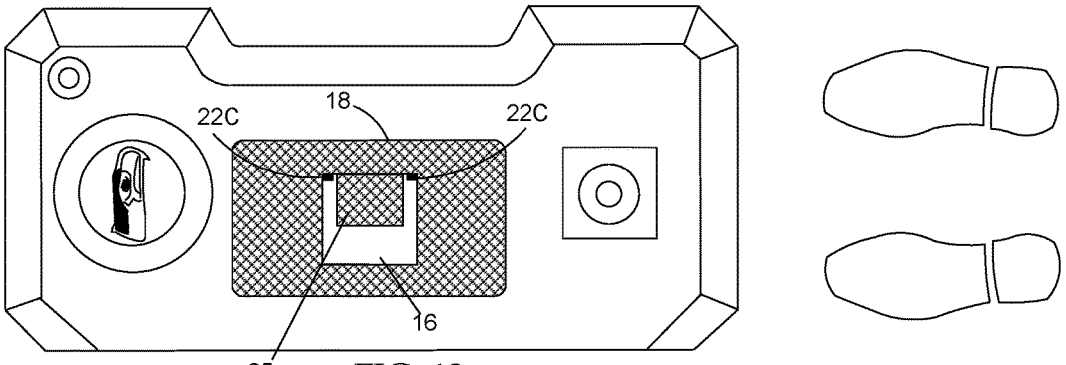
Figure 16:
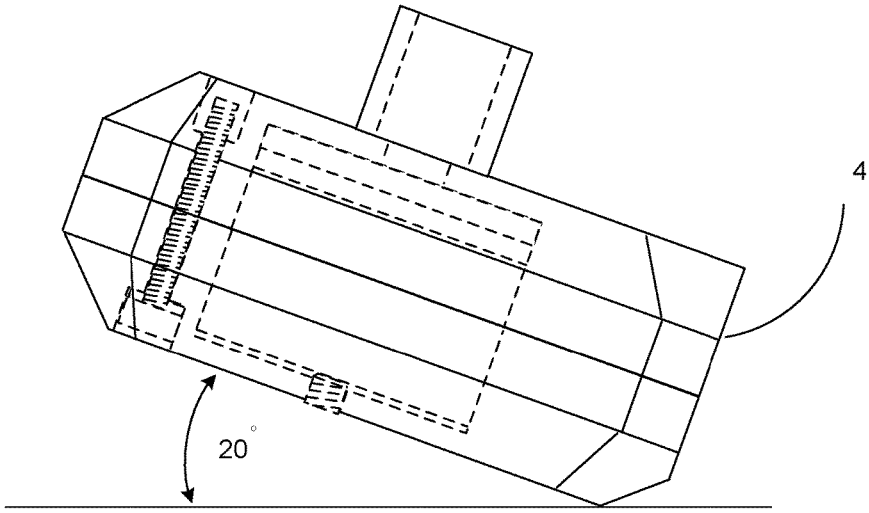

In FIG. 13, the golfer wishes to press forward to a greater degree. Square 25 has moved further rearward within window 16 and slashes 22C are still visible. However, slashes 22A-22B are covered by darkened section 18 and are no longer visible. The golfer is positioned with his eyes over the ball and putter head 2 is at an angle so that striking face 4 will strike the golf ball of approximately 20 degrees (FIG. 16).

Although the above-preferred embodiments have been described with specificity, persons skilled in this art will recognize that many changes to the specific embodiments disclosed above could be made without departing from the spirit of the invention. For example, although the above preferred embodiments discussed the utilization of transparent acrylic and a transparent window 16, in other preferred embodiments the acrylic and window 16 could be semi-transparent or translucent. Also, although the above preferred embodiments discussed the utilization of a golf ball marker for display in display chamber 6, other types of objects may likewise be displayed. For example, coins could also be placed in display chamber 6. Also, for example, an insect (such as a bee) could be molded within transparent acrylic and also placed inside display chamber 6 for decorative display. Also, it should be recognized that in another preferred embodiment slashes 22A-22C could be replaced by other types of markings such as site lines, boxes or circles, for example. Therefore, the attached claims and their legal equivalents should determine the scope of the invention.

What is claimed is:

1. A putter, comprising:

A. a putter head, comprising:

1. an upper putter head comprising an upper putter head top side and an upper putter head bottom side,
2. a lower putter head comprising a lower putter head top side and a lower putter head bottom side, wherein said lower putter head is removably attached to said upper putter head, B. a striking face formed into said putter head, C. a transparent object display chamber, sandwiched between said upper putter head and said lower putter head, wherein said object display chamber is fully enclosed by said upper putter head and said lower putter head, D. a display object removable positioned within said object display chamber, E. a transparent positioning window comprising markings for providing assistance in proper golfer positioning and in proper striking face positioning, wherein said upper putter head and said lower putter head are fabricated from a transparent material.

2. The putter as in claim 1, wherein said transparent object display chamber and said transparent positioning window are material is acrylic.

3. The putter as in claim 1, wherein said display object comprises a removable weight for customizing the weight of said putter.

4. The putter as in claim 1, wherein said display object comprises a magnetized object.

5. The putter as in claim 1, further comprising a set screw extending through said lower putter head and into said object display chamber for securing said display object.

6. A putter, comprising:

A. a putter head, comprising:

1. an upper putter head comprising an upper putter head top side and an upper putter head bottom side,
2. a lower putter head comprising a lower putter head top side and a lower putter head bottom side, wherein said lower putter head is removably attached to said upper putter head, B. a striking face formed into said putter head, C. a transparent object display chamber, sandwiched between said upper putter head and said lower putter head, wherein said object display chamber is fully enclosed by said upper putter head and said lower putter head, D. a display object removable positioned within said object display chamber, E. a transparent positioning window comprising markings for providing assistance in proper golfer positioning and in proper striking face positioning, wherein said display object comprises a removable weight for customizing the weight of said putter, wherein said display object further comprises a magnet glued to said removable weight.

7. A putter, comprising:

A. a putter head, comprising:

1. an upper putter head comprising an upper putter head top side and an upper putter head bottom side,
2. a lower putter head comprising a lower putter head top side and a lower putter head bottom side, wherein said lower putter head is removably attached to said upper putter head, B. a striking face formed into said putter head, C. a transparent object display chamber, sandwiched between said upper putter head and said lower putter head, wherein said object display chamber is fully enclosed by said upper putter head and said lower putter head, D. a display object removable positioned within said object display chamber, E. a transparent positioning window comprising markings for providing assistance in proper golfer positioning and in proper striking face positioning, wherein said display object is a golf ball marker.

8. A putter, comprising:

A. a putter head, comprising:

1. an upper putter head comprising an upper putter head top side and an upper putter head bottom side,
2. a lower putter head comprising a lower putter head top side and a lower putter head bottom side, wherein said lower putter head is removably attached to said upper putter head, B. a striking face formed into said putter head, C. a transparent object display chamber, sandwiched between said upper putter head and said lower putter head, wherein said object display chamber is fully enclosed by said upper putter head and said lower putter head, D. a display object removable positioned within said object display chamber, E. a transparent positioning window comprising markings for providing assistance in proper golfer positioning and in proper striking face positioning, wherein said markings are placed on said upper putter head top side, said upper putter head bottom side, said lower putter head top side and said lower putter head bottom side.

9. The putter as in claim 8, wherein said markings comprise:

A. a first darkened section on said upper putter head top side, said darkened section surrounding said transparent positioning window, B. a second darkened section on said upper putter head bottom side, said second darkened section surrounding said transparent positioning window and viewable through said transparent positioning window, C. a plurality of slashes on said lower putter head top side, said plurality of slashes viewable through said transparent positioning window, D. a third darkened section on said lower putter head bottom side, said third darkened section viewable through said transparent positioning window, and E. a lightened section on said lower putter head bottom side, said lightened section viewable through said transparent positioning window and surrounding said third darkened section.

10. The putter as in claim 9, wherein said first darkened section, said second darkened section, said third darkened section and said lightened section are utilized to properly position a golfer's eyes in relation to a golf ball.

11. The putter as in claim 9, wherein said first darkened second and said plurality of slashes are utilized to assist a golfer in pressing forward.

* * * * *